United States Patent [19]

Muth

[11] Patent Number: 4,693,380

[45] Date of Patent: Sep. 15, 1987

[54] RACK SUPPORT

[75] Inventor: William Muth, Ocala, Fla.

[73] Assignee: Clairson International, Ocala, Fla.

[21] Appl. No.: 943,888

[22] Filed: Dec. 19, 1986

Related U.S. Application Data

[63] Continuation of Ser. No. 705,504, Feb. 25, 1985, abandoned.

[51] Int. Cl.[4] ..... A47F 7/08

[52] U.S. Cl. ..... 211/35; 108/46; 211/38; 248/225.1; 248/242; 403/391; 403/397

[58] Field of Search ..... 248/225.2, 225.1, 222.1, 248/240, 242, 250, 241, 302, 303; 211/35, 36, 37, 38, 99, 104, 149; 108/134, 46; 403/391, 397

[56] References Cited

U.S. PATENT DOCUMENTS

| | | | |
|---|---|---|---|
| 485,589 | 11/1892 | Ravenel et al. | 248/242 |
| 2,195,579 | 4/1940 | Murdock | 248/242 |
| 2,452,689 | 11/1948 | Sheppard | 211/35 X |
| 2,483,758 | 10/1949 | Douglas | 248/242 |
| 4,361,099 | 11/1982 | Kokenge et al. | 108/134 X |

OTHER PUBLICATIONS

ADM, "Mister Shelf", Brochure, ADM Industries Inc; Dated 9-1-79.

Greenfield Shelving Brochure, Greenfield Metal Products, (Undated).

"Storage Systems"Brochure, Lee/Rowan, Builder Products, 1985.

*Primary Examiner*—Ramon O. Ramirez

*Attorney, Agent, or Firm*—Cushman, Darby & Cushman

[57] ABSTRACT

A support member for an inclined open mesh or wire type shelf that can be spaced anywhere along a wall and shelf area to provide support for the inclined shelf. The support is a one piece molded structure having a T-type cross-section with the shank having curved lower and upper ends with those curves providing about a 60° angle of inclination for the shelf. One end includes a flat surface for engaging the wall with the other end including a forwardly directed groove for receiving a crosswise support in the middle of the shelf and a pair of grooves extending perpendicular to that forwardly directed groove sized so that that end of the support can snap in place between two stringers within the shelf structure.

8 Claims, 6 Drawing Figures

Fig. 4
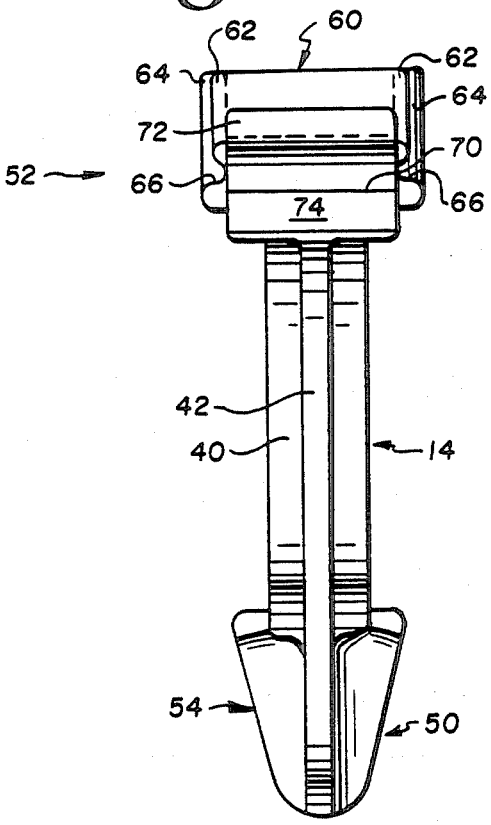
Fig. 5
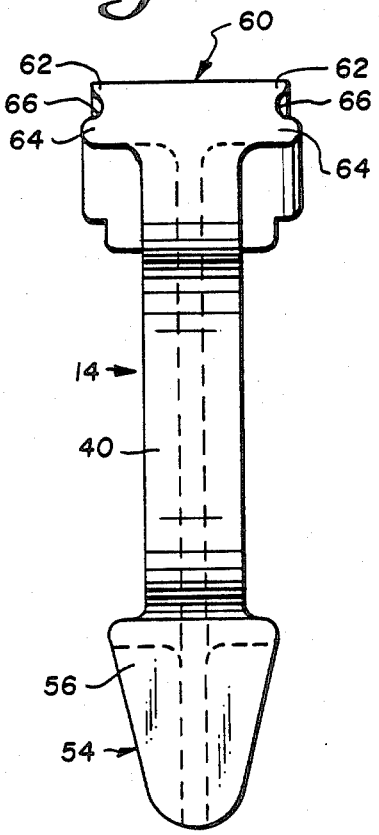
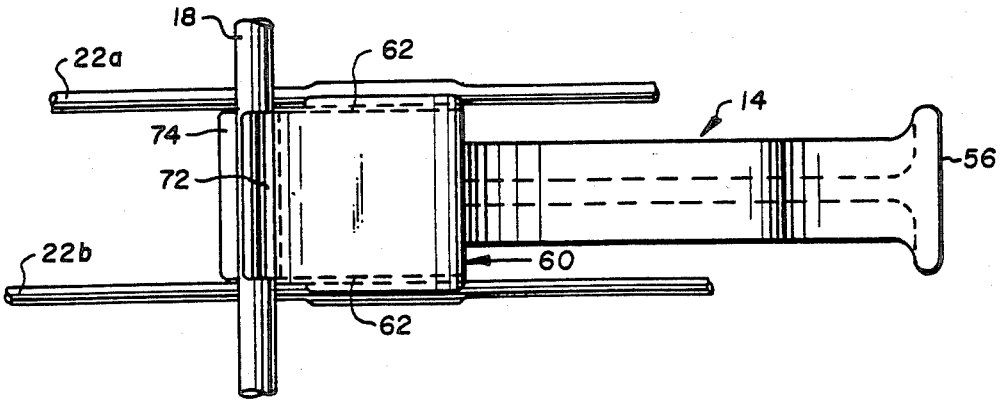
Fig. 6

RACK SUPPORT

This is a continuation of application Ser. No. 705,504, filed Feb. 25, 1985, which was abandoned upon the filing hereof.

FIELD OF THE INVENTION

This invention concerns a support device for use with an angled rack or shelf.

BACKGROUND OF THE PRESENT INVENTION

For several years, open wire type shelving has been available. Horizontal shelves of this type have traditionally been supported along their lateral surfaces, such as along the back edge, both side edges and occasionally at intervals along the front edge. Exemplary structures are set forth in Stempel, U.S. Pat. Nos. 3,598,064 and 3,765,634.

Shelving systems have also been mounted to a wall by means of vertical wall supports in which removable brackets fit and serve to support shelving. Examples are shown in U.S. Pat. Nos. 3,092,047 and 3,353,684. Multiple rack shelves are also known where a plurality of different types of shelves are combined together into a system, again supported most usually by means of vertical support rods themselves fixed to the wall. Exemplary of such a system is Stroh, U.S. Pat. No. 3,993,002, Karnes, U.S. Pat. No. 1,954,935, and Shell, U.S. Pat. No. 3,085,693. In Shell, in order to make an angled or downwardly inclined shelf, Shell employed a shelf tilting device comprised of a stamped piece of sheet metal having a generally T-shaped body with one portion adapted to fit within an associated upright support member and another portion provided with a slot to receive one of the support fingers of the bracket.

Knupp, U.S. Pat. No. 1,949,017, discloses an inclined, wall mounted shoe display rack comprised of an inclined frame, the upper portion of which being secured to the wall by an eye and screw, while the lower portion acts as a brace movably mounted to the lower or outer end of the inclined frame. The brace is angled approximately 45 degrees back toward the wall from the inclined frame and is held in place and not permitted to pivot beyond the 45° by arms provided at the sides of the lower end of the inclined frame.

Derman, U.S. Pat. No. 1,984,827, also discloses inclined shelving which is held in place by means of a support block secured to the inner surface of side supporting rails to which the inclined shelf is pivotally attached.

However, none of these devices allow an inclined shelf to be supported anywhere along its length. Rather, support is provided only where the vertical shelf supports are fixed to the wall.

Additionally, supports for shelves close to the floor, as those used for shoe racks, which depend from the front edge are in the way and can be kicked. Further, such legs impede access to the area beneath the shelf and can be hit by one's shoes when walking up to the shelf or when moving laterally along the length of the shelf system.

SUMMARY OF THE PRESENT INVENTION

As explained above, the shelf support device, according to the present invention, is for use with open wire type shelving, the open wire network being formed from spaced, horizontal support rods or bars across which a plurality of smaller sized parallel rods, wires or stringers are placed with the stringers forming the support surface while the horizontal rods or bars provide the structural support for the shelf. The stringers may be welded or otherwise secured to the rods at the crossing points and preferably all the rods and stringers are coated with a plastic film such as a vinyl plastic. This could, however, be replaced by other surface finishes or coatings.

In each shelf there can be front, middle and rear support rods that extend parallel to one another with at least one in each section of the shelf with this group all lying in the same plane. Additional rods can be placed at the front and the rear above or below the plane of the front and rear rods but still parallel to the front and rear rods to provide additional support. The stringers are arranged perpendicularly to the rods and can be bent towards the additional front or rear rods and secured thereto as well to provide a stop member or more strength. Alternatively, the shelf could be comprised of a generally rectangular outer frame with a plurality of crossing elements including preferably a middle support wire, extending parallel with the front and rear of the shelf with the various wire elements being secured together again by welding or any other convenient securing means.

The support device for the angled shelf, according to the present invention, is an integrally molded structure that will extend from beneath the shelf to the wall on which the shelf is mounted. The support device is comprised of a main longitudinally extending body which terminates at two end portions, one of which is designed to engage the flat wall surface and terminates with a flat support surface. That end portion is preferably angled upwardly from the main body portion at an angle of about 30° from the axis of the main shank portion.

The other or head end includes a shaped, forwardly directed groove or slot extending parallel to the flat support surface at the other end and thus also with the wall on which the shelf is mounted. In addition, a pair of parallel grooves, extending substantially perpendicularly with respect to the first groove, are formed in the head end with one being positioned on each side of the head. The part of the head end structure which defines the upper part of this pair of grooves is dimensioned a distance slightly greater than the spacing between adjacent stringers within the shelf so that when the head is to be actually inserted into the shelf, the first groove extending parallel to the wall will fit over and receive the middle horizontal support rod while the head will be forced between adjacent stringers and snapped in place therebetween so that a stringer will lie in each one of the pair of perpendicular side grooves.

Other objects, features, and characteristics of the present invention as well as the methods and operation and functions of the related elements of the structure, and to the combination of parts and economies of manufacture, will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

FIG. 4 is a front elevation of the support shown in FIG. 2;

FIG. 5 is a rear elevation of the support shown in FIG. 2; and

FIG. 6 is a top, plan view of the support according to the present invention positioned within the shelf structure, portions of which have been cut away for clarity.

DETAILED DESCRIPTION OF THE PRESENT INVENTION

Figure 1:
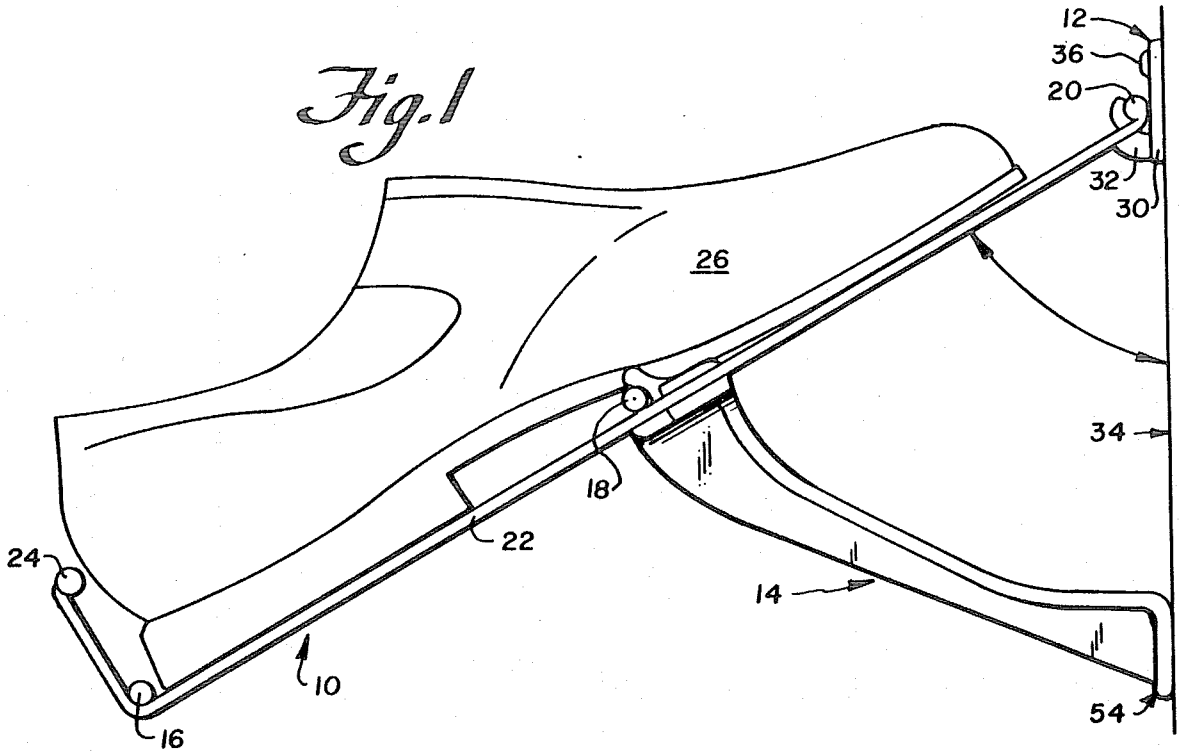
FIG. 1 is a diagrammatic, perspective view of an inclined shelf supported by the support means according to the present invention.
Figure 3:
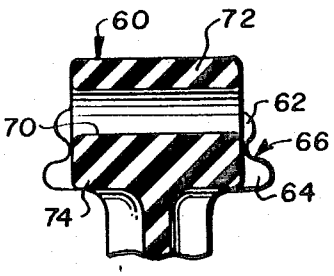
FIG. 3 is a cross-section taken along the lines 3—3 in FIG. 2.
Figure 2:
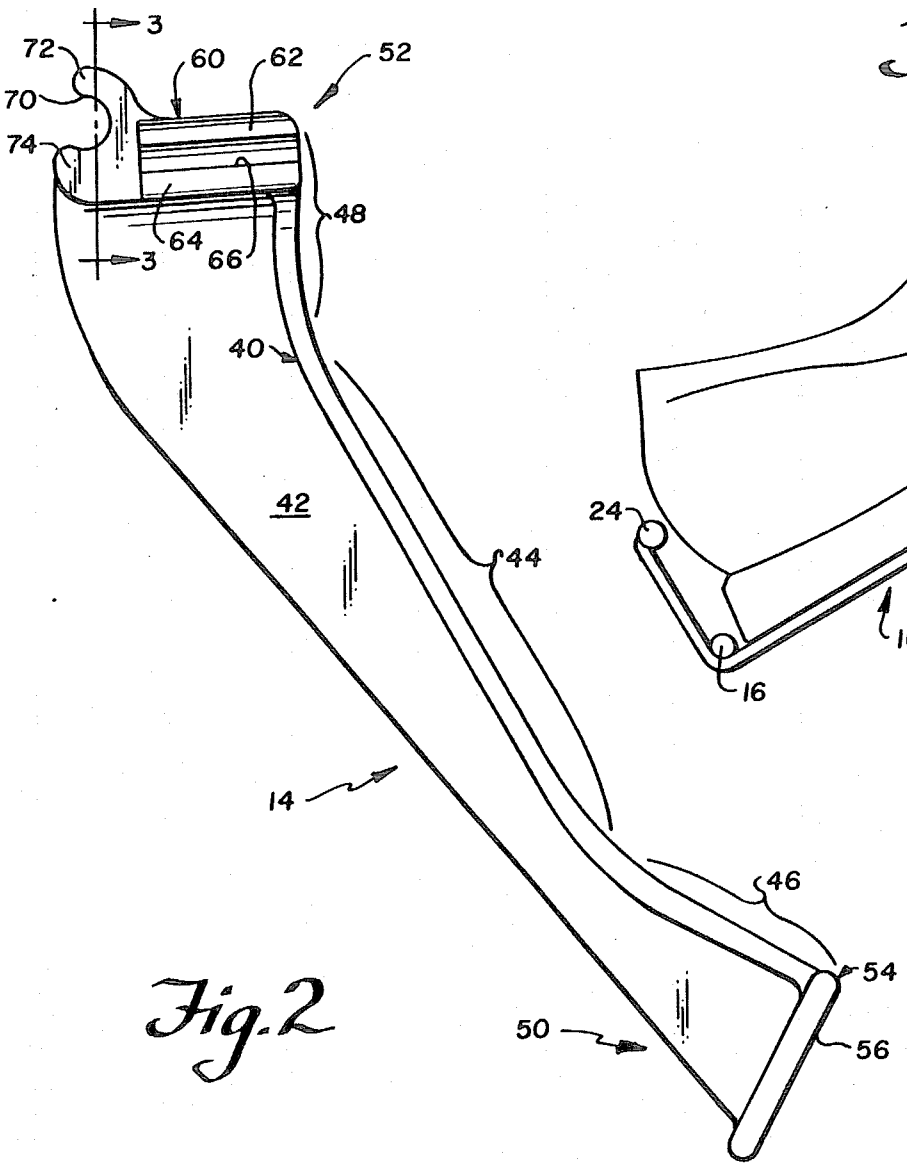
FIG. 2 is a side, elevational view of the support according to the present invention.

Turning now to FIG. 1, the shelf, generally indicated at 10 is supported on the wall, for example, by a pivot mount 12 that allows the rear of the shelf to pivot therein. The shelf is otherwise supported preferably by a plurality of support members made according to this invention, one of which is generally indicated at 14.

Shelf 10, which can be a single shelf or part of a system, is comprised of a front rod 16, a middle rod 18 and a rear rod 20 and spanning therebetween, are a series of stringers 22. At the front of the shelf 10, stringers 22 are bent upwardly at right angles and the upper tips thereof are connected together by means of an additional front, horizontal rod 24. This portion of stringers 22 and the presence of rod 24 provide a stop such as for example against which a shoe, indicated at 26, will rest, thereby preventing the shoe from sliding off. It should be understood, however, the inclined shelf could also be used for any other items from books and magazines, to newspapers, to sweaters or any other articles of clothing.

Pivot 12 is comprised of a rear mounting plate 30 and a hook portion 32 with the pivot mount itself being held to the wall, indicated at 34, by means of a screw 36. However, any type of mount for the rear of the inclined shelf could be used to hold the rear of the shelf against the wall.

With reference to FIGS. 2–5, support 14 is a one piece molded unit, preferably formed from a plastic material, such as high impact styrene. However, other moldable materials could also be used such as plastic, thermoplastic, including polyetheylene, or other forms of reacted plastic materials or even metals, such as aluminum steel, or various alloyed metals. The support 14 is formed so as to have a relatively flat back member 40 from which web member 42 depends. Back member 40, preferably rectangular in cross-section, is divided into a middle section 44, a lower or bottom section 46 and an upper or head section 48. It should be noted that head section 48 is at approximately a 30° angle with respect to the middle section 44 and similarly, the lower section 46 is also at an approximately 30° angle in the same direction with respect to the middle section 44. Together, the two bent end portions define about a 60° angle. However, it should be understood that other angles could also be used to provide the desired inclined angle for the shelf system.

Support 14 includes a lower end generally indicated at 50 and an upper or head end indicated at 52. The lower head 50 is comprised of an extension of web 42 adjacent the lower section 46 of back member 40 with back 40 terminating at a support pad 54 extending perpendicular to the lower section of back 40, and having an exposed flat face or surface 56, perhaps best shown in FIG. 5. It should be noted that end surface 56 faces outwardly or away from the middle section 44 and with respect to web 42 and the general axis of middle section 44. Accordingly, end face 56 is positioned so as to extend perpendicularly across the device. Because flat surface 56 is exposed and because the lower section 46 of back 40 is angled at about 30°, support pad 54 will provide the support for the shelf against the wall when surface 56 is in contact with wall 34.

The head or upper end 52 includes a block member, generally indicated at 60, which is formed with a pair of side protrusions 62 and 64 which extend outwardly from each side thereof to define a groove 66 therebetween. It should be noted that protrusions 62 extend outwardly a lesser distance from the side of head member 60 than do protrusions 64 so that protrusions 62 can be forced between two adjacent stringers 22, but protrusions 64 will not fit therethrough. While the width between the pair of protrusions 62 is just greater than the width between stringers 22, the interior of the grooves is dimensioned to just fit around the pair of adjacent stringers. In particular, reference is made to FIG. 6 wherein stringers 22*a* and 22*b* are set forth with head member 60 being shown therebetween with stringers 22*a* and 22*b* each being in place respectively within one of the pair of grooves 66.

Head 60 also includes a forwardly directed groove 70 defined by an upper lip 72 and a lower lip 74. Groove 70 is designed to fit snugly around middle rod 18, this again being shown specifically in FIGS. 1 and 6, but it is only essential that groove 70 butt against rod 18, there does not need to be a snap-type fit.

With the upper and lower sections being both angled at about 30°, respectively, with respect to the middle section 44, the angle of shelf 10 with respect to wall 34 is preferably about 60° but this angle can vary anywhere from about 30° to about 80° depending on the use of the shelf and the angle desired.

The overall length, from end to end, is about 6.5 inches. Back 40 is about one half inch wide with web 42 ranging in height from about one quarter inch to about one inch at head end 52. Grooves 66 are preferably spaced apart by 0.875 inches with the distance across protrusions 62 and 64 being about 0.969 and 1.125, respectively. However, protrusions 62 and 64 will be sized according to the shelf with which they will be used.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims, which scope is to be accorded the broadest interpretation so as to encompass all such modifications and equivalent structures.

What I claim is:

1. An angled shelf support member comprised of a main body section having a longitudinal axis and integrally formed with upper and lower end sections, said lower end section being positioned at an angle to said main body section and including an outwardly facing flat end surface positioned so as to extend perpendicularly across said lower end section, said upper end section including a front portion and opposite side portions, first means defining a first groove extending across the front portion of said upper end section so as to be parallel to said flat surface and second means defining a pair of spaced apart grooves, one extending along each of said opposite side portions of said upper end section, said pair of grooves extending perpendicularly to said first groove, with said pair of grooves being arranged at an angle with respect to said longitudinal axis.

2. A shelf support member as in claim 1 wherein said support member is integrally molded.

3. A shelf support member as in claim 2, wherein said support member is comprised of plastic.

4. A shelf support member as in claim 1, wherein the upper and lower end sections are each positioned at an acute angle with respect to the longitudinal axis of said main body section.

5. A shelf support member as in claim 1, wherein said angle is about 30°.

6. A shelf support member as in claim 1, wherein said first groove is positioned vertically above the plane defined by said pair of grooves.

7. A wall mounted shelf system comprised of an open grid shelf member comprised of front, middle, and rear support rods across which a plurality of spaced apart stringers are connected, mounting means for pivotally mounting said shelf system to a wall and at least one shelf system support member for providing vertical support for said shelf system, said support member being comprised of a main body section having a longitudinal axis and integrally formed with upper and lower end sections, said lower end section being positioned at an angle to said main body section and including an outwardly facing flat end surface positioned so as to extend perpendicularly across said lower end section thereof, said upper end section including a front portion and opposite side portions, first means defining a first groove extending across the front portion of said upper end section so as to be parallel to said flat surface and second means defining a pair of spaced apart grooves, one extending along each of said opposite side portions of said upper end sections, said pair of grooves extending perpendicularly to said first groove, with said pair of grooves being arranged at an angle with respect to said longitudinal axis.

8. A wall mounted shelf system as in claim 7 including a plurality of said shelf system support members.

* * * * *